United States Patent [19]

Marolewski et al.

[11] 4,252,662

[45] * Feb. 24, 1981

[54] FUNCTIONAL FLUIDS CONTAINING AMMONIUM SALTS OF PHOSPHORUS ACIDS

[75] Inventors: Theodore A. Marolewski, New City; Fred Jaffe, Ossining, both of N.Y.

[73] Assignee: Stauffer Chemical Company, Westport, Conn.

[ * ] Notice: The portion of the term of this patent subsequent to Mar. 2, 1993, has been disclaimed.

[21] Appl. No.: 658,428

[22] Filed: Feb. 17, 1976

Related U.S. Application Data

[63] Continuation-in-part of Ser. No. 441,698, Feb. 11, 1974, abandoned.

[51] Int. Cl.[3] ..... C10M 3/40

[52] U.S. Cl. ..... 252/78.5

[58] Field of Search ..... 252/78, 49.8, 49.9, 252/78.5

[56] References Cited

U.S. PATENT DOCUMENTS

| | | | |
|---|---|---|---|
| 3,311,560 | 3/1967 | Hotten | 252/78 X |
| 3,707,501 | 12/1972 | Gentit et al. | 252/78 |
| 3,790,487 | 2/1974 | Burrous | 252/78 |
| 3,793,199 | 2/1974 | Schlicht | 252/78 X |
| 3,941,708 | 3/1976 | Gentit et al. | 252/78 |
| 3,956,154 | 5/1976 | Marolewski et al. | 252/78 |

OTHER PUBLICATIONS

Preprint of Symposium on Deposit, Wear and Emission Control by Lubricants and Fuel Additives, Division of Petroleum Chemistry, Inc., Amer. Chem. Soc., N.Y.C. Meeting, Sep. 7-12, 1969.

*Primary Examiner*—Harris A. Pitlick

*Attorney, Agent, or Firm*—Roger S. Benjamin

[57] ABSTRACT

A composition and method for inhibiting damage in a functional fluid by incorporating therein a damage inhibiting amount of an ammonium salt of a phosphorus acid in accordance with the formula:

wherein R, R′, R″, R‴ can be the same or different and wherein R and R′ can be conjoint and contain oxygen, nitrogen, and mixtures thereof; and represent alkyl, aralkyl, and alkenyl groups containing from 1 to about 30 carbon atoms, X represents oxygen or sulfur, Y′ and Y″ represent lower alkoxy, lower thioalkoxy, alkenyloxy, thioalkenyloxy, lower alkyl, carboalkoxyalkyl, phenyl lower alkyl, thiophenoxy, aryloxy, alkaryloxy, aralkoxy and lower alkylthiophenoxy, Z represents oxygen or sulfur, and m equals 1 or 2.

6 Claims, 1 Drawing Figure

CONTAMINATION OF PHOSPHATE ESTER FLUID WITH CHLORINATED SOLVENTS
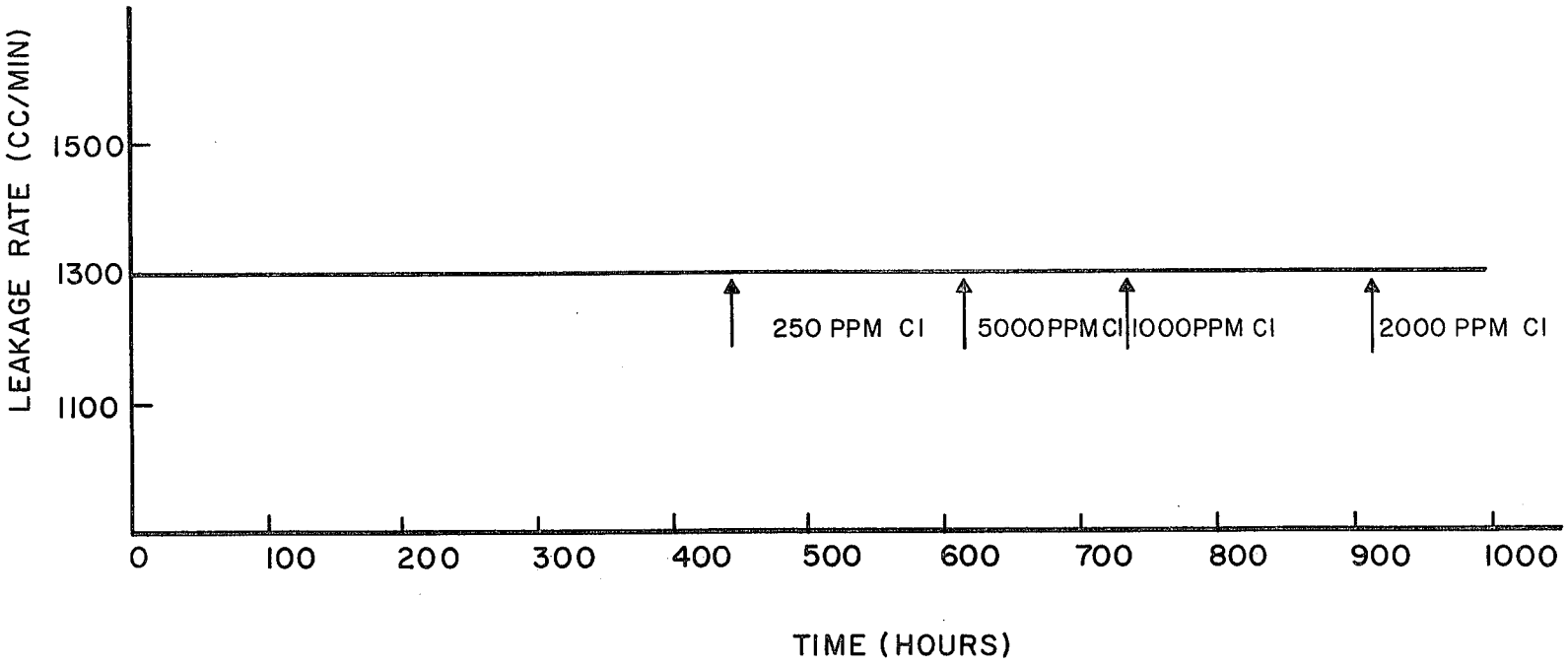

FUNCTIONAL FLUIDS CONTAINING AMMONIUM SALTS OF PHOSPHORUS ACIDS

This is a continuation-in-part of application Ser. No. 441,698, now abandoned.

BACKGROUND OF THE INVENTION

This invention relates to functional fluid compositions having the ability to inhibit and control damage to mechanical members in contact with these fluid compositions.

A wide variety of functional fluids are known and utilized for many applications. Functional fluids have been used as electronic coolants, atomic reactor coolants, diffusion pump fluids, lubricants, damping fluids, bases for grease, power transmission and hydraulic fluids, heat transfer fluids, heat pump fluids, refrigeration equipment fluids and as filter mediums for air conditioning systems.

In many of the functional fluid compositions used for the above purposes there have been reports of damage to the fluid during use and to mechanical members, especially metallic members in contact with the fluid, as evidenced by a loss of weight of such members, due to the wearing away of metallic parts. Damage has been reported in aircraft hydraulic systems, gas turbine bearings, jet turbine control systems, steam turbine bearings, steam turbine control systems, electrohydraulic control systems and aerospace control equipment. Damage has also been observed on such materials as glass, Teflon, Mylar, Plexiglass and members constructed from other non-metallic materials.

In those instances where functional fluids are used in the hydraulic systems of aircraft and aerospace systems, such systems impose stringent requirements on the hydraulic fluid. Not only must these hydraulic fluids meet stringent use requirements but they must also satisfy FAA and other government requirements for fire resistance. Additionally, the hydraulic fluid must be capable of performing in the hydraulic system over an extended period of time without causing significant damage or functional impairment to the various conduits, valves, pumps, and the like, through which the fluid flows in the course of such use.

Damage caused by functional fluids contacting valves and other members has been attributed to the wearing away or erosion of the environment in contact with the functional fluid in a hydraulic system. Among the many undesirable results caused by such damage is a marked decrease in strength of the structural mechanical parts in the hydraulic system, such as pumps and valves, along with an alteration of the geometry of these parts. Such changes in the case of pumps can cause a decrease in pumping efficiency, and in the case of valves can cause faulty operations, excessive leakage and even hazardous conditions.

This damage necessitates costly and time consuming premature overhaul of mechanical parts. Additionally, metal removed from component metallic mechanical parts in contact with the functional fluid contaminates the fluids, causes filter clogging aind excessive filter replacement, and requires premature draining and replacement of the fluid in the system. The metal contamination can also cause a change in physical and chemical properties of the functional fluids.

Metal contaminants can also reduce the oxidative stability of a fluid, thereby adversely affecting fluid performance. In addition, metal contamination of the fluid can manifest itself in numerous other ways, including viscosity change, increased acid number, formation of precipitates, decrease in chemical stability and discoloration.

Another problem in the industry is the unavoidable contamination of aircraft and electrohydraulic control systems with chlorinated solvents used to clean the systems and components. A detailed discussion of this problem appears in *Vickers 22nd Fluid Power Conference Report,* Oct. 30, 1972, Section 4, Pages 25–29. Contamination by chlorinated solvents decreases the service life of functional fluids and accelerates damage, causing excessive internal leakage in hydraulic systems to a point of malfunction. No additive heretofore known has satisfactorily overcome the problems associated with chlorinated solvent contamination of functional fluids.

In the past, there have been reports of damage to valves and other metallic members which contact phosphate ester fluids. U.S. Pat. No. 2,470,792 proposes to overcome this damage problem by the inclusion of a small percentage of water in an aircraft hydraulic system. Unfortunately, while the presence of a small percentage of water reduces certain types of damage when incorporated in some phosphate ester hydraulic fluids, the presence of water can have a corrosive effect as well as an undesirable effect on the stability of the fluid.

U.S. Pat. No. 3,707,501 discloses the use of phosphonium compounds to inhibit erosion damage to the metallic environment containing hydraulic fluids. However, the lubricant compositions require relatively high concentrations of phosphonium compounds, which are very expensive. In addition, the phosphonium compounds may contribute to the destabilization of the functional fluid.

U.S. Pat. No. 3,679,587 discloses alkali salts of perfluorinated alkyl sulfonic acids as erosion inhibitors. However, since these compositions are ash containing materials, high temperature operation could lead to the formation of particulate matter in a hydraulic system.

SUMMARY OF THE INVENTION

In accordance with the present invention, a functional fluid has been discovered which exhibits enhanced low erosion, shear, oxidative and thermal stability, and fire resistance characteristics, and is particularly suitable for aircraft hydraulic applications. This invention comprises the incorporation of a minor percentage of certain ammonium salts of phosphorus acids into various base stocks compositions so as to produce a functional fluid capable of inhibiting damage to the metal environment containing the functional fluid.

DETAILED DESCRIPTION OF THE INVENTION

The ammonium salts of the phosphorus acids which are useful for incorporation in functional fluids in accordance with the present invention are represented by the following formula and description:

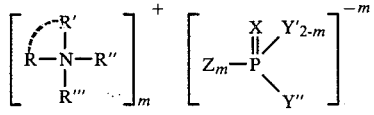

wherein R, R′, R″, and R‴ can be the same or different and wherein R and R′ can be conjoint and contain oxygen, nitrogen, and mixtures thereof; and represent alkyl, aralkyl, and alkenyl groups containing from 1 to about 30 carbon atoms, X represents oxygen or sulfur, Y′ and Y″ represent lower alkoxy, lower thioalkoxy, alkenyloxy, thioalkenyloxy, lower alkyl, carboalkoxyalkyl, phenyl lower alkyl, thiophenoxy, aryloxy, alkaryloxy, aralkoxy and lower alkylthiophenoxy, Z represents oxygen or sulfur, and m equals 1 or 2. In a preferred embodiment, m=1.

An alternative embodiment involves the ammonium ions attached to the phosphorus anion via an alkylene or arylene group. This forms a zwitterion wherein the ions are connected, generally by a carbon or carbon and oxygen chain, as for example:

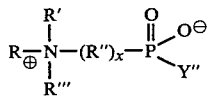

wherein R, R′ and R‴ are as above and R″ can be any divalent connecting unit such as $CH_2$, and x can vary from 1 to 10. Representative of the above is:

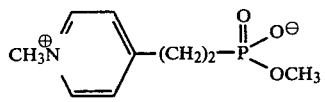

The following is a listing of typical ammonium salts of phosphorus acids tabulated according to the respective ammonium ions and phosphorus ester anions:

| Ammonium Ions | Phosphorus Ester Anions |
|---|---|
| Dodecyl trimethyl ammonium | Diphenyl phosphate |
| Hexadecyl trimethyl ammonium | Phenyl phosphate (bis-amine salt) |
| Octadecyl trimethyl ammonium | Dimethyl phosphate |
| Tridecyl trimethyl ammonium | Methyl phosphate (bis-amine salt) |
| Decyl trimethyl ammonium | Methyl methylphosphonate |
| Didodecyl dimethyl ammonium | Methylphosphonate (bis-amine salt) |
| Dimethyl propyl dodecyl ammonium | Diethyl phosphate |
| Dioctyl dimethyl ammonium | Ethyl phosphate (bis-amine salt) |
| Dodecylbenzyl trimethyl ammonium | Dioctyl phosphate |
| | Dibenzyl phosphate |
| | Diallyl phosphate |
| Dodecyl dimethyl butyl ammonium | Methyl phenyl phosphate |
| | Bis(octylphenyl) phosphate |
| Benzyl trimethyl ammonium | Di-n-dodecyl phosphate |
| Allyl tributyl ammonium | Diethyl dithiophosphate |
| Trimethyl hexadecenyl ammonium (Unsaturated R Group) | Di-n-butyl-dithiophosphate |
| | Dibenzyl dithiophosphate |
| Heptadecyl trimethyl ammonium | Diphenyl dithiophosphate |
| Trioctyl methyl ammonium | Bis(nonyl phenyl) phosphate |
| Nonyl trimethyl ammonium | Dibutyl phosphate |
| Tris(n-tridecyl) methyl ammonium | Methyl octylphosphonate |
| Tris(n-dodecyl) methyl ammonium | Hexadecyl phosphonate |
| Tris(isooctyl) methyl ammonium | Methyl hexadecyl phosphonate |
| Dimethyl butyl hexadecyl ammonium | Methyl tertiary-butyl phosphonate |
| Triethyl methyl ammonium | Methyl carbomethoxymethyl phosphonate |
| 2-ethylhexyl dimethyl dodecyl ammonium | |
| Dimethyl ethyl dodecyl ammonium | |
| Dimethyl butyl dodecyl ammonium | |
| Trimethyl dodecyl ammonium | |

-continued

| Ammonium Ions | Phosphorus Ester Anions |
|---|---|
| Hexadecyl dimethyl ethyl ammonium | |
| Tris(dodecyl) butyl ammonium | |
| Tetramethyl ammonium | |
| Trimethyl benzyl ammonium | |
| 4-acetyl N-methyl pyridinium | |

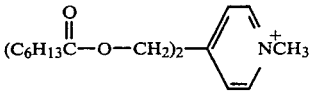

| | |
|---|---|
| 1-(N,N-dimethyl)-1-imidazolium | |
| 1-(N,N-dimethyl)-1-pyrrazolium | |
| N-methyl oxazolium | |
| N-butyl quinolinium | |
| N-methyl pyrrolium | |
| N,N-diethyl pyrrolidinium | |
| N-methyl,N-hexyl piperidinium | |
| N-methyl,N-butyl piperidinium | |
| N-isopropyl thiazolium | |
| N-ethyl,N-methyl phenothiazinium | |
| N-methyl pyridinium | |

Members of the ammonium ions can be combined with members of the phosphorus ester anions to generate typical compounds which can be used in this invention. For example, particularly preferred ammonium salts of phosphorus acids are:

Hexadecyl trimethyl ammonium diphenyl phosphate
Decyl trimethyl ammonium diphenyl phosphate
Didodecyl dimethyl ammonium diphenyl phosphate
Dimethyl propyl dodecyl ammonium diphenyl phosphate
Dodecylbenzyl trimethyl ammonium diphenyl phosphate
Allyl tributyl ammonium diphenyl phosphate
Trimethyl hexadecenyl ammonium diphenyl phosphate
Bis(dodecyl trimethyl ammonium)phenyl phosphate
Bis(octadecyl trimethyl ammonium)phenyl phosphate
Decyl trimethyl ammonium dimethyl phosphate
Didodecyl dimethyl ammonium methyl methylphosphonate
Bis(didodecyl dimethyl ammonium)methylphosphonate
dodecyl trimethyl ammonium dimethyl phosphate
Dodecyl trimethyl ammonium dibenzyl phosphate
Dodecyl trimethyl ammonium methyl phenyl phosphate
Dodecyl trimethyl ammonium bis(nonylphenyl)phosphate
Dodecyl trimethyl ammonium diphenyl dithiophosphate
Octadecyl trimethyl ammonium diphenyl dithiophosphate
Dodecyl trimethyl ammonium diethyl dithiophosphate
Dodecyl trimethyl ammonium diallyl phosphate
Dodecyl trimethyl ammonium diphenyl phosphate
Didodecyl dimethyl ammonium di-n-dodecyl phosphate
Dodecyl trimethyl ammonium di-n-dodecyl phosphate
Benzyl trimethyl ammonium methyl phenyl phosphate
Trimethyl hexadecenyl ammonium methyl phenyl phosphate
Octadecyl trimethyl ammonium diphenyl phosphate
Tridecyl trimethyl ammonium diphenyl phosphate
Heptadecyl trimethyl ammonium diphenyl phosphate
Benzyl trimethyl ammonium dibenzyl dithiophosphate
Hexadecyl trimethyl ammonium dimethyl phosphate
Trioctyl methyl ammonium diphenyl phosphate
Heptadecyl trimethyl ammonium dimethyl phosphate Tris(n-tridecyl)methyl ammonium diphenyl phosphate
Tris(n-dodecyl)methyl ammonium diphenyl phosphate
Tris(isooctyl)methyl ammonium diphenyl phosphate
Dimethyl butyl hexadecyl ammonium dibutyl phosphate
Triethyl methyl ammonium methyl methylphosphonate
N-methyl, N-butyl piperidinium dibutyl phosphate
2-ethylhexyl dimethyl dodecyl ammonium diphenyl phosphate
Dimethyl ethyl dodecyl ammonium diethyl phosphate
Dimethyl butyl dodecyl ammonium dibutyl phosphate
Trimethyl dodecyl ammonium methyl methylphosphonate
Hexadecyl dimethyl ethyl ammonium diethyl phosphate
Tris(dodecyl)butyl ammonium dibutyl phosphate
Tetramethyl ammonium methyl octylphosphonate
Trimethyl benzyl ammonium methyl octylphosphonate
Tetramethyl ammonium methyl hexadecylphosphonate
Benzyl trimethyl ammonium methyl hexadecylphosphonate
Tetramethyl ammonium methyl tertiary-butyl-phosphonate
Benzyl trimethyl ammonium methyl tertiary-butyl-phosphonate
Tetramethyl ammonium methyl carbomethoxymethyl-phosphonate
Benzyl trimethyl ammonium methyl carbomethoxymethylphosphonate
Trimethyl tertiary-octylphenyl ammonium diphenyl phosphate
Trimethyl tertiary-octylphenyl ammonium methyl methylphosphonate
Trimethyl tertiary-octylphenyl ammonium bis(nonylphenyl)phosphate
Tetramethyl ammonium bis(nonylphenyl)phosphate
Benzyltrimethyl ammonium bis(nonylphenyl) phosphate

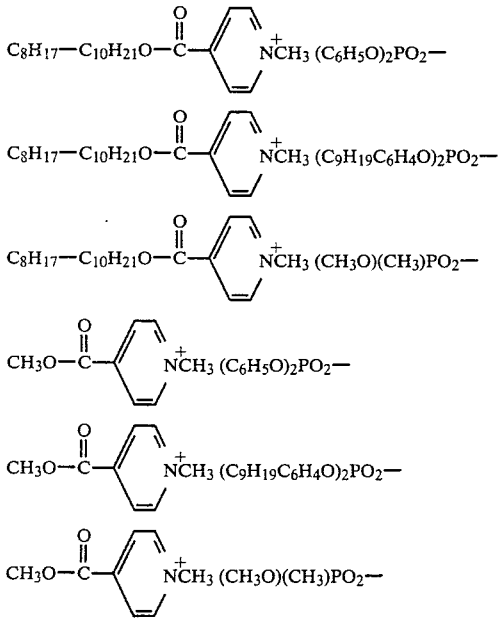

The quaternary ammonium salts of diesters of phosphoric acid which contain no N-H bonds can be prepared by known means as outlined in British Pat. No. 1,199,015 (1970) and in the preprints of the Symposium on Deposit, Wear, and Emission Control by Lubricants and Fuel Additives presented in the Division of Petroleum Chemistry of the American Chemical Society, N.Y. City Meeting, Sept. 7–12, 1969, page A-110. These methods include:

1. Reaction of an amine with a triester of phosphoric acid in which the triester alkylates the amine. These reactions usually take place above 40°–60° and can be run neat or in alcohol solvents. All volatile species are then removed by distillation to leave behind the phosphoric acid diester salt of a quaternary ammonium cation.

$$RR^1R^2N + R^3OPOR_2^4 \rightarrow R^1R^2R^3N^{\oplus}R\ OPOR_2^{4\ominus}$$

where R, $R^1$ and $R^2$ can be the same or different and wherein R and $R^1$ can be conjoint and can contain one or more heterocyclic atoms, such as oxygen, nitrogen, and mixtures thereof; and represent alkyl, aralkyl, and alkenyl groups. $R^3$ is preferably of the benzyl, allyl or lower alkyl (especially methyl) type, $R^4$ can be alkyl, aryl, alkaryl, alkoxy, aryloxy, alkaryloxy, alkyloxy, and also substituted alkyl, such as carboalkoxy, carboalkoxyalkyl, carboalkoxyaryl and the like.

These reactions are well known in the art. Reactions of primary aromatic amines are discussed in Thomas et al, Journal of the American Chemical Society, Volume 68, at page 895 (1946). Reactions of secondary and tertiary amines are discussed in Clark et al, Journal of the Chemical Society, page 2023 (1950); Atherton et al, ibid, page 1106, (1948) and Baddiley et al, ibid, page 815 (1949). Reactions of mixed aryl alkyl phosphate esters with pyridine are discussed in Osborne, Journal of Organic Chemistry, Volume 29, page 3570 (1964); See also Kirby et al, Organic Chemistry of Phosphorus, page 209 ff., (Elsevier 1967). For reactions of phosphoric acid triesters, see Kosolapoff et al, Organic Phosphorus Compounds, Volume 6, at pages 236, 515 and 523–526 (Wiley-Interscience, 1973). For reactions of phosphonates with nucleophiles, see Hudson, Structure and Mechanism in Organophosphorus Chemistry, pg. 110 (Academic Press 1965).

2. Reaction of the phosphoric acid diester with a quaternary ammonium hydroxide to generate the salt in a neutralization reaction and then removal of the water liberated.

$$\begin{matrix}(RO)_2\\ P(O)(OH)\end{matrix} + R_4N(OH) \rightarrow R_4N^{\oplus}O^{\ominus}P(O)(OR)_2 + \begin{matrix}-\\ H_2O\end{matrix}$$

3. Reaction of the quaternary ammonium halide with the sodium or potassium salt of the phosphoric acid diester and extraction of the phosphate with a solvent such as acetone to enable removal of the sodium of potassium chloride.

$$(RO)_2\,P(O)(O)^{\ominus}Na^{\oplus} + R_4N^{\oplus}Cl^{\ominus} \downarrow R_4N^{\oplus}\ OP(O)(OR)_2 + NaCl$$

Erosion exhibited by hydraulic fluids has been related to the electrical properties of the fluid in Boeing Scientific Research Laboratories Document D1-82-0847. It has been proposed that erosion caused by hydraulic fluids can be controlled by eliminating ionic impurities present in the fluid, or by significantly increasing the conductivity of the fluid.

Both approaches have been explored with some degree of success. This is surprising due to the fact that eliminating ionic impurities actually lowers the conductivity. This appears to indicate two contradictory approaches to the problem of ameliorating damage caused by erosion. Recent experiments have shown that the elimination of ionic impurities by filtration through an activated clay will control erosion caused by a phosphate ester hydraulic fluid. However, this is not a practical solution since erosion begins again soon after the filtration is discontinued. In addition, filtration on aircraft is virtually impossible.

The addition of ammonium salts of phosphorus acids to various base stocks has been found to effectively inhibit damage. Furthermore, conductivity measurements of these fluids containing ammonium salts of phosphorus acids indicated increased conductivity. It is too early to conclusively attribute conductivity as an explanation of the mechanism, or for evaluating the effectiveness of damage inhibitors. However, conductivity does serve as some indicia, although further research in this area is deemed necessary and desirable.

Typical conductivities of commercial phosphate ester aircraft hydraulic fluids on the market today vary from about 0.02 to about 6 micromhos/centimeter.

Functional fluid compositions to which the ammonium salt of phosphorus acid compositions can be added are referred to as base stocks. They include, but are not limited to esters and amides of phosphorus acids, mineral oil and synthetic hydrocarbon oil base stocks, hydrocarbyl silicates, silicones, aromatic ether and thioether compounds, chlorinated biphenyl, monoesters, dicarboxylic acid esters, esters of polyhydric compounds, polyalkylene ether glycols and alcohols as well as their esters.

The concentration of ammonium salts of phosphorus acids in the functional fluid is adjusted in terms of the particular system and the functional fluid to inhibit and control damage. Thus, it has been found that the additive response, that is, the concentration of an ammonium salt of phosphorus acid required to inhibit and control damage of a base stock varies according to the base stock or blends of base stocks employed.

Thus, for the base stocks useful in the practice of this invention the concentration of ammonium salts of phosphorus acid is from about 0.01 percent to about 15 percent by weight, the particular concentration being that amount which will effectively inhibit and control damage. The preferred additive concentration is from about 0.025 to about 5 weight percent, more preferably, from about 0.1 to about 0.5 weight percent. Therefore, included within the present invention are compositions comprising a functional fluid and a damage-inhibiting amount of an ammonium salt of phosphorus acids, that is, the ammonium salt is added, in a concentration sufficient to control and inhibit damage. The functional fluid compositions of this invention can be compounded in any manner known to those skilled in the art for the incorporation of an additive into a base stock and preferably, by adding an ammonium salt of phosphorus acids to the base stock with stirring until a fluid composition is obtained.

As indicated above, the compositions of this invention can employ a wide variety of base stocks. Particularly, suitable base stock materials are the esters and amides of an acid of phosphorus represented by the structure:

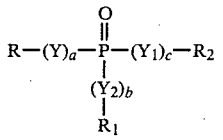

wherein Y is selected from the group consisting of oxygen, sulfur and

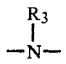

$Y_1$ is selected from the group consisting of oxygen, sulfur and

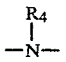

and $Y_2$ is selected from the group consisting of oxygen, sulfur and

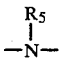

R, $R_1$, $R_2$, $R_3$, $R_4$ and $R_5$ are each selected from the group consisting of alkyl, alkoxy, aryl, substituted aryl and substituted alkyl wherein R, $R_1$, $R_2$, $R_3$, $R_4$ and $R_5$ each can be identical or different with respect to any other radical, and a, b and c are whole numbers having a value of 0 to 1 and the sum of a+b+c is from 1 to 3.

Generally, the number of carbon atoms in the alkyl groups will vary from 1 to 30. Included within the alkyl groups are the cycloalkyls and alkyl substituted cycloalkyls. Typical examples of alkyl radicals are as follows: methyl, ethyl, normal propyl, isopropyl, normal butyl, isobutyl, secondary butyl, tertiary butyl, normal amyl, isoamyl, 2-methylbutyl, 2,2-dimethyl propyl, 1-methyl butyl, diethylmethyl, 1,2-dimethyl propyl, tertiary amyl, normal hexyl, 1-methylamyl, 1-ethyl butyl, 1,2,2-trimethyl propyl, 3,3-dimethyl butyl, 1,1,2-trimethyl propyl, 2-methyl amyl, 1,1-dimethyl butyl, 1-ethyl 2-methyl propyl, 1,3-dimethyl butyl, isohexyl, 3-methylamyl, 1,2-dimethyl butyl, 1-methyl 1-ethyl propyl, 2-ethyl butyl, normal heptyl, 1,1,2,3-tetramethyl propyl, 1,2-dimethyl 1-ethyl propyl, 1,1,2-trimethyl butyl, 1-isopropyl 2-methyl propyl, 1-methyl 2-ethyl butyl, 1,1-diethyl propyl, 2-methyl hexyl, 1,1-dimethyl amyl, 1-isopropyl butyl, 1-ethyl 3-methyl butyl, 1,4-dimethyl amyl, isoheptyl, 1-methyl 1-ethyl butyl, 1-ethyl 2-methyl butyl, 1-methyl hexyl, 1-propyl butyl, normal octyl, 1-methyl heptyl, 1,1-diethyl 2-methyl propyl, 1,1,3,3-tetramethyl butyl, 1,1-diethyl butyl, 1,1-dimethyl hexyl, 1-methyl 1-ethyl amyl, 1-methyl 1-propyl butyl, 2-ethyl hexyl, 6-methyl heptyl (iso-octyl), normal nonyl, 1-methyl octyl, 1-ethyl heptyl, 1,1-dimethyl heptyl, 1-ethyl 1-propyl butyl, 1,1-diethyl 3-methyl butyl, diisobutyl methyl, 3,5,5-trimethyl hexyl, 3,5-dimethyl heptyl, normal decyl, 1-propyl heptyl, 1,1-diethyl hexyl, 1,1-dipropyl butyl, 2-isopropyl 5-methyl hexyl and $C_{11}$–$C_{18}$ alkyl groups such as dodecyl, tridecyl, hexadecyl and the like. Also included are aralkyl groups, e.g., benzyl, alpha- or beta-phenylethyl, alpha-alpha dimethyl benzyl and the like, with the alkyl portion having from 1 to 30 carbon atoms. Also included are cyclobutyl, cyclohexyl, cycloheptyl and the like. Also included are alkaryl groups such as methylphenyl, ethylphenyl and the like. Also included are alkoxy alkyl such as methoxy ethyl, ethoxy ethyl, butoxyethyl, butoxy butyl and the like.

Typical examples of substituted alkyl radicals are the haloalkyl radicals which can be represented by the structure:

$$C_nHal_{2n+1-m}H_mC(Hal)_2\overset{\overset{R_6}{|}}{\underset{\underset{R_7}{|}}{C}}$$

where Hal refers to a halogen, m is less than or equal to 2n+1 and n may have any value from 0 to 18, and $R_6$ and $R_7$ can be hydrogen, halogen such as F, Cl, Br and I, or alkyl radicals. Preferred radicals are those where Hal is fluoro and include those represented by the following formulas:

| | |
|---|---|
| $CF_3\overset{\overset{R_6}{\vert}}{\underset{\underset{R_7}{\vert}}{C}}-$ | $CF_3CF_2\overset{\overset{R_6}{\vert}}{\underset{\underset{R_7}{\vert}}{C}}-$ |
| $CF_3CH_2\overset{\overset{R_6}{\vert}}{\underset{\underset{R_7}{\vert}}{C}}-$ | $CF_3(CF_2)_2\overset{\overset{R_6}{\vert}}{\underset{\underset{R_7}{\vert}}{C}}-$ |
| $CF_3(CF_2)_3\overset{\overset{R_6}{\vert}}{\underset{\underset{R_7}{\vert}}{C}}-$ | $CF_3(CF_2)_4\overset{\overset{R_6}{\vert}}{\underset{\underset{R_7}{\vert}}{C}}-$ |
| $CF_3(CF_2)_5\overset{\overset{R_6}{\vert}}{\underset{\underset{R_7}{\vert}}{C}}-$ | $CF_3(CF_2)_6\overset{\overset{R_6}{\vert}}{\underset{\underset{R_7}{\vert}}{C}}-$ |
| $CF_3(C_2H_5)\overset{\overset{R_6}{\vert}}{C}-$ | $CF_3(C_3H_7)\overset{\overset{R_6}{\vert}}{C}-$ |
| $CF_3(C_4H_9)\overset{\overset{R_6}{\vert}}{C}-$ | $CF_3(C_5H_{11})\overset{\overset{R_6}{\vert}}{C}-$ |
| $CF_3(C_6H_{13})\overset{\overset{R_6}{\vert}}{C}-$ | $CF_3(C_7H_{15})\overset{\overset{R_6}{\vert}}{C}-$ |
| $CF_3(C_8H_{17})\overset{\overset{R_6}{\vert}}{C}-$ | $CF_3CF_2(C_2H_5)\overset{\overset{R_6}{\vert}}{C}-$ |
| $CF_3CF_2(C_3H_7)\overset{\overset{R_6}{\vert}}{C}-$ | $CF_3CF_2(C_4H_9)\overset{\overset{R_6}{\vert}}{C}-$ |
| $CF_3CF_2(C_5H_{11})\overset{\overset{R_6}{\vert}}{C}-$ | $CF_3CF_2(C_6H_{13})\overset{\overset{R_6}{\vert}}{C}-$ |
| $CF_3(C_6H_{13})\overset{\overset{R_6}{\vert}}{C}-$ | $CF_3CF_2(C_8H_{17})\overset{\overset{R_6}{\vert}}{C}-$ |
| $CF_3(CF_2)_2(C_2H_5)\overset{\overset{R_6}{\vert}}{C}-$ | $CF_3(CF_2)_2(C_3H_7)\overset{\overset{R_6}{\vert}}{C}-$ |
| $CF_3(CF_2)_2(C_4H_9)\overset{\overset{R_6}{\vert}}{C}-$ | $CF_3(CF_2)_2(C_5H_{11})\overset{\overset{R_6}{\vert}}{C}-$ |
| $CF_3(CF_2)_2(C_6H_{13})\overset{\overset{R_6}{\vert}}{C}-$ | $CF_3(CF_2)_2(C_7H_{15})\overset{\overset{R_6}{\vert}}{C}-$ |
| $CF_3(CF_2)_2(C_8H_{17})\overset{\overset{R_6}{\vert}}{C}-$ | $CF_3(CF_2)_3(C_2H_5)\overset{\overset{R_6}{\vert}}{C}-$ |
| $CF_3(CF_2)_2(C_8H_{17})\overset{\overset{R_6}{\vert}}{C}-$ | $CF_3(CF_2)_3(C_2H_5)\overset{\overset{R_6}{\vert}}{C}-$ |

-continued

| | |
|---|---|
| $CF_3(CF_2)_3(C_3H_7)\overset{\overset{R_6}{\vert}}{C}-$ | $CF_3(CF_2)_3(C_4H_9)\overset{\overset{R_6}{\vert}}{C}-$ |
| $CF_3(CF_2)_3(C_5H_{11})\overset{\overset{R_6}{\vert}}{C}-$ | $CF_3(CF_2)_3(C_6H_{13})\overset{\overset{R_6}{\vert}}{C}-$ |
| $CF_3(CF_2)_3(C_7H_{15})\overset{\overset{R_6}{\vert}}{C}-$ | $CF_3(CF_2)_3(C_8H_{17})\overset{\overset{R_6}{\vert}}{C}-$ |
| $CF_3(CF_2)_4(C_2H_5)\overset{\overset{R_6}{\vert}}{C}-$ | $CF_3(CF_2)_4(C_3H_7)\overset{\overset{R_6}{\vert}}{C}-$ |
| $CF_3(CF_2)_4(C_4H_9)\overset{\overset{R_6}{\vert}}{C}-$ | $CF_3(CF_2)_4(C_5H_{11})\overset{\overset{R_6}{\vert}}{C}-$ |
| $CF_3(CF_2)_4(C_6H_{13})\overset{\overset{R_6}{\vert}}{C}-$ | $CF_3(CF_2)_4(C_7H_{15})\overset{\overset{R_6}{\vert}}{C}-$ |
| $CF_3(CF_2)_4(C_8H_{17})\overset{\overset{R_6}{\vert}}{C}-$ | $CF_3(CF_2)_5(C_2H_5)\overset{\overset{R_6}{\vert}}{C}-$ |
| $CF_3(CF_2)_5(C_3H_7)\overset{\overset{R_6}{\vert}}{C}-$ | $CF_3(CF_2)_5(C_4H_9)\overset{\overset{R_6}{\vert}}{C}-$ |
| $CF_3(CF_2)_5(C_5H_{11})\overset{\overset{R_6}{\vert}}{C}-$ | $CF_3(CF_2)_5(C_6H_{13})\overset{\overset{R_6}{\vert}}{C}-$ |
| $CF_3(CF_2)_5(C_7H_{15})\overset{\overset{R_6}{\vert}}{C}-$ | $CF_3(CF_2)_5(C_8H_{17})\overset{\overset{R_6}{\vert}}{C}-$ |
| $CF_3C(C_3H_7)_2-$ | $CF_3C(C_4H_9)_2-$ |
| $CF_3C(CH_3)_2-$ | $CF_3C(C_2H_5)_2-$ |

where $R_6$ and $R_7$ have their aforedescribed significance.

The halogenated alkyl radicals can be primary, secondary or tertiary.

Other suitable fluorine-containing radicals include fluorinated alkoxyalkyl radicals particularly those represented by the following formulas:

| | |
|---|---|
| $C_2H_5OCH_2CF_2CF_2\overset{\overset{R_6}{\vert}}{\underset{\underset{R_7}{\vert}}{C}}-$ | $C_3H_7OCH_2CF_2CF_2\overset{\overset{R_6}{\vert}}{\underset{\underset{R_7}{\vert}}{C}}-$ |
| $C_4H_9OCH_2CF_2CF_2\overset{\overset{R_6}{\vert}}{\underset{\underset{R_7}{\vert}}{C}}-$ | $C_5H_{11}OCH_2CF_2CF_2\overset{\overset{R_6}{\vert}}{\underset{\underset{R_7}{\vert}}{C}}-$ |
| $C_6H_{13}OCH_2CF_2CF_2\overset{\overset{R_6}{\vert}}{\underset{\underset{R_7}{\vert}}{C}}-$ | $C_2H_5OCH_2CF_2CF_2CF_2\overset{\overset{R_6}{\vert}}{\underset{\underset{R_7}{\vert}}{C}}-$ |
| $C_3H_7OCH_2CF_2CF_2CF_2\overset{\overset{R_6}{\vert}}{\underset{\underset{R_7}{\vert}}{C}}-$ | $C_4H_9OCH_2CF_2CF_2CF_2\overset{\overset{R_6}{\vert}}{\underset{\underset{R_7}{\vert}}{C}}-$ |
| $C_5H_{11}OCH_2CF_2CF_2CF_2\overset{\overset{R_6}{\vert}}{\underset{\underset{R_7}{\vert}}{C}}-$ | $C_6H_{13}OCH_2CF_2CF_2CF_2\overset{\overset{R_6}{\vert}}{\underset{\underset{R_7}{\vert}}{C}}-$ |
| $C_2H_5OCH_2(CF_2)_4\overset{\overset{R_6}{\vert}}{\underset{\underset{R_7}{\vert}}{C}}-$ | $C_3H_7OCH_2(CF_2)_4\overset{\overset{R_6}{\vert}}{\underset{\underset{R_7}{\vert}}{C}}-$ |
| $C_4H_9OCH_2(CF_2)_4\overset{\overset{R_6}{\vert}}{\underset{\underset{R_7}{\vert}}{C}}-$ | $C_5H_{11}OCH_2(CF_2)_4\overset{\overset{R_6}{\vert}}{\underset{\underset{R_7}{\vert}}{C}}-$ |
| $C_6H_{13}OCH_2(CF_2)_4\overset{\overset{R_6}{\vert}}{\underset{\underset{R_7}{\vert}}{C}}-$ | |

where $R_6$ and $R_7$ have their aforedescribed significance.

It is also contemplated within the scope of this invention that the hydrogen and the fluorine in the previously described haloalkyl radicals can be replaced by other halogens, such as chlorine or bromine.

Typical examples of aryl and substituted aryl radicals are phenyl, cresyl, xylyl, halogenated phenyl, alkoxylated phenyl, cresyl and xylyl in which the available hydrogen on the aryl or substituted aryl is partially or totally replaced by a halogen, o-, m- and p- trifluoromethylphenyl, o-, m- and p-2,2,2-trifluoroethylphenyl, o-, m- and p-3,3,3-trifluoropropylphenyl and o-, m-, and p-4,4,4-trifluorobutylphenyl. Also included are isopropylphenyl, butylphenyl, alpha-alkylbenzylphenyl and alpha,alpha-dialkylbenzylphenyl, e.g. alpha-methylbenzylphenyl, alpha,alpha dimethylbenzyl phenyl.

The orthosilicates useful as base stocks include the tetraalkyl orthosilicates such as tetra(octyl)orthosilicates, tetra(2-ethylhexyl)orthosilicates and the tetra(isooctyl) orthosilicates and those in which the isooctyl radicals are obtained from isooctyl alcohol which is derived from the oxo process, and the (trialkoxysilico)-trialkyl orthosilicates, otherwise referred to as hexa(alkoxy) disiloxanes, such as hexa(2-ethylbutoxy) disiloxane and hexa(2-ethylhexoxy) disiloxane.

The preferred tetraalkyl orthosilicates and hexa(alkoxy) disiloxanes are those in which the alkyl or alkoxy radicals have from 4 to 12 carbon atoms and in which the total number of carbon atoms in the orthosilicate is from 16 to 60.

In addition to the hexa(alkoxy) disiloxanes referred to above, other hexa(alkoxy) disiloxanes can be used in which the aliphatic radical of the alkoxy groups are for example, 1-ethylpropyl, 1,3-dimethylbutyl, 2-methylpentyl, 1-methylhexyl, 1-ethylpentyl, 2-butylhexyl and 1-methyl-4-ethyloctyl.

The orthosilicates and alkoxy polysiloxanes can be represented by the general structure:

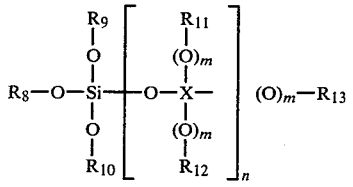

wherein $R_8$, $R_9$ and $R_{10}$ each can be alkyl, substituted alkyl, aryl, substituted aryl and can be identical or different with respect to any other radical, O is oxygen, Si is silicon, X is a member of the group consisting of carbon and silicon, m is a whole number having a value of 0 or 1, n is an integer having a value of from 1 to about 200 or more and when X is carbon, m is 0, n is 1 and $R_{11}$, $R_{12}$ and $R_{13}$ each can be hydrogen, alkyl, substituted alkyl, aryl and substituted aryl radicals and when X is silicon m is 1, n is an integer having a value of from 1 to about 200 or more and $R_{11}$, $R_{12}$ and $R_{13}$ each can be alkyl, substituted alkyl, aryl and substituted aryl.

Typical examples of substituted aryl radicals are o-, m- and p-chlorophenyl, o-, m- and p-bromophenyl, o-, m- and p-fluorophenyl, alpha,alpha,alpha-trichlorocresyl, alpha,alpha,alpha-trifluorocresyl, xylyl and o-, m- and p-cresyl. Typical examples of alkyl and haloalkyl radicals are those heretofore described.

The siloxanes or silicones useful as base stocks are represented by the general structure:

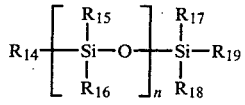

wherein $R_{14}$, $R_{15}$, $R_{16}$, $R_{17}$, $R_{18}$ and $R_{19}$ can each be alkyl, substituted alkyl, aryl and substituted aryl radicals and n is a whole number from about 0 to about 2000 or more. Typical examples of alkyl and haloalkyl radicals along with the number of carbon atoms are those heretofore described. Typical examples of the siloxanes are poly(methyl) siloxane, poly(methyl, phenyl) siloxane. poly(methyl, chlorophenyl) siloxane and poly(methyl, 3,3,3-trifluoropropyl) siloxane.

Typical examples of substituted aryl radicals and o-, m- and p- chlorophenyl, o-, m- and p-bromophenyl, o-, m- and p-fluorophenyl, alpha,alpha,alpha-trichlorocresyl, alpha, alpha, alpha-trifluorocresyl, o-, m- and p-cresyl and xylyl.

Dicarboxylic acid esters which are suitable as base stocks are represented by the structure:

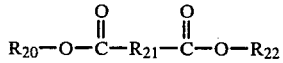

wherein $R_{20}$ and $R_{22}$ are each selected from the group consisting of alkyl, substituted alkyl, aryl and substituted aryl and $R_{21}$ is a divalent radical selected from the group consisting of alkylene and substituted alkylene, and are prepared by esterifying dicarboxylic acids such as adipic acid, azelaic acid, suberic acid. secabic acid, hydroxysuccinic acid, fumaric acid, maleic acid, etc., with alcohols such as butyl alcohol, hexyl alcohol, 2-ethylhexyl alcohol, dodecyl alcohol, 2,2-dimethyl heptanol, 1-methyl cyclohexyl methanol, and the like.

Typical examples of alkyl, aryl substituted alkyl and substituted aryl radicals are given above.

Polyesters which are suitable as base stocks are represented by the structure:

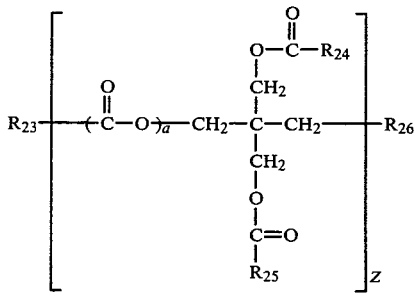

wherein $R_{23}$ is selected from the group consisting of hydrogen and alkyl, $R_{24}$ and $R_{25}$ are each selected from the group consisting of alkyl, substituted alkyl, aryl and substituted aryl, a is a whole number having a value of 0 to 1, Z is a whole number having a value of 1 to 2 and when Z is 1, $R_{26}$ is selected from the group consisting of hydrogen, alkyl acyloxy and substituted acyloxy and when Z is 2, $R_{26}$ is oxygen, and are prepared by esterifying such polyalcohols as pentaerythritol, dipentaerythritol, trimethylolpropane, trimethylolethane and neopentyl glycol with such acids as propionic, butyric, isobutyric, n-valeric, capric, caproic, n-heptylic, caprylic, 2-ethylhexanoic, 2,2-dimethylheptanoic and pelargonic. Typical examples of alkyl, substituted alkyl, aryl and substituted aryl radicals are given above.

Other esters which are also suitable as base stocks are the mono esters.

Another class of compositions which are suitable as base stocks for this invention are the polyphenyl ethers, polyphenyl thioethers, or mixtures thereof, as represented by the structure:

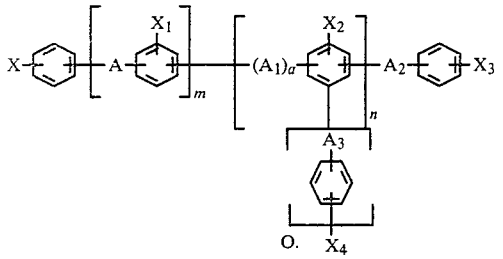

wherein A, $A_1$, $A_2$, and $A_3$ are each a chalcogen having an atomic number of 8 to 16, X, $X_1$, $X_2$, $X_3$ and $X_4$ each are selected from the group consisting of hydrogen, alkyl, haloalkyl, halogen, arylalkyl and substituted arylalkyl, m, n and o are whole numbers, each having a value of 0 to 8 and a is a whole number having a value of 0 to 1 provided that when a is 0, n can have a value of 1 to 2. Typical examples of alkyl and substituted alkyl radicals are given above. Typical examples of such base stocks are 2- to 7-ring ortho-, meta- and para-polyphenyl ethers and mixtures thereof, 2- to 7-ring ortho-, meta-, and para-polyphenyl thioethers and mixtures thereof, mixed polyphenyl ether-thioether compounds in which at least one of the chalcogens represented by A, $A_1$, $A_2$ and $A_3$ is dissimilar with respect to any one of the other chalcogens, dihalogenated diphenyl ethers, such as 4-bromo-3'-chlorodiphenyl ethers and bisphenoxy biphenyl compounds and mixtures thereof.

Hydrocarbon oils including mineral oils derived from petroleum sources and synthetic hydrocarbon oils are suitable base stocks. The physical characteristics of functional fluids derived from a mineral oil are selected on the basis of the requirements of the fluid system and therefore this invention includes as base stocks mineral oils having a wide range of viscosities and volatilities such as naphthenic base, paraffinic base and mixed base mineral oils.

The synthetic hydrocarbon oils include but are not limited to those oils derived from oligomerization of olefins such as polybutenes and oils derived from high or alpha-olefins of from 4 to 20 carbon atoms such as by acid catalyzed dimerization and then oligomerization using mixtures of aluminum alkyls and titanium halides as catalysts, or Friedel-Crafts catalysts, or peroxide catalysts.

Chlorinated biphenyls and terphenyls are also useful as base stocks.

The fluid compositions of this invention when utilized as a functional fluid can also contain acid acceptors, dyes, pour point depressants, thickeners, antioxidants, antifoam agents, viscosity index improvers such as polyalkyl acrylates, polyalkyl methacrylates, polycyclic polymers polyurethanes, polyalkylene oxides and polyesters, lubricity agents, water and the like.

It is also contemplated that the base stocks as aforementioned can be utilized singly or as a blend containing two or more base stocks in varying proportions.

Most often, the base stock material will contain esters and/or amides of an acid of phosphorus, and blends of the aforesaid with one or more of the following materials: mineral oils, synthetic hydrocarbon oils, orthosilicates, alkoxypolysiloxanes, silicones, polyphenyl ethers, polyphenyl thioethers, chlorinated biphenyls, esters of dicarboxylic acids and monohydric alcohols, esters of monocarboxylic acids and monohydric alcohols, esters of monocarboxylic acids and polyhydric alcohols, polyalkylene ether alcohols and esters thereof, and blends thereof. The base stocks can also contain other fluids which include, in addition to the functional fluids, desired fluids derived from coal tar products, synthetics, and synthetic oils, e.g., alkylene polymers (such as polymers of propylene, butylene, etc., and mixtures thereof), alkylene oxide type polymers (e.g., propylene oxide polymers), and derivatives, including alkylene oxide polymers prepared by polymerizing the alkylene oxide in the presence of water or alcohol, e.g., ethyl alcohol, alkyl benzenes, (e.g., monoalkyl benzene such as dodecyl benzene, tetradecyl benzene, etc.) and dialkyl benzene (e.g., n-nonyl 2-ethyl hexyl benzene); polyphenyls, (e.g., biphenyls and terphenyls), halogenated benzene, halogenated lower alkyl benzene and monohalogenated diphenyl ethers.

In the preferred form of the present invention, the ammonium salt of phosphorus acid composition of the present invention is combined with a phosphate ester functional fluid base stock. The base stock will consist primarily of trialkylphosphates being present in amounts from 50 to 95% by weight and preferably from 60 to 90% by weight. The trialkylphosphates which give optimum results are those wherein each of the alkyl groups contain from 1 to 20 carbon atoms, preferably from 3 to 12 carbon atoms and more preferably, from 4 to 9 carbon atoms. The alkyl groups are preferably of straight chain configuration. A single trialkyl phosphate can contain the alkyl group in all three positions or can possess a mixture of different alkyl groups. Mixtures of various trialkyl phosphates can be used. Suitable species of trialkyl phosphates which can be employed as the base stock composition include tripropyl phosphates, tributyl phosphates, trihexyl phosphates, trioctyl phosphates, dipropyl octyl phosphates, dibutyl octyl phosphates, dipropyl hexyl phosphate, dihexyl octyl phosphate, dihexyl propyl phosphate, and propyl butyl octyl phosphate.

The trialkyl phosphates can be combined with triaryl phosphates or mixed alkyl aryl phosphates. Preferred triaryl phosphates are tricresyl phosphate, cresyl diphenyl phosphate, trixylenyl phosphate, tertiary-butylphenyl phenyl phosphates, ethylphenyl dicresyl phosphate or isopropylphenyl diphenyl phosphate, phenylbis(4-alpha-methylbenzylphenyl) phosphate, diphenyl decyl phosphate, diphenyl octyl phosphate, methyl diphenyl phosphate, butyl dicresyl phosphate and the like. In one preferred embodiment, a base stock containing primarily trixylenyl phosphate is employed. The triaryl phosphates function as a thickener for the trialkyl phosphates. Thus, the amount of triaryl phosphate may range between 0 to 35% by weight. The preferred range of the triaryl phosphates will be from about 5 to about 30% by weight of the composition.

Conventional polymeric thickeners or viscosity index (VI) improvers can be blended with the mixture of trialkyl and triaryl phosphate material to achieve the desired viscosity. Typical thickeners used can be polyacrylates, polymethacrylates, polyethylene oxides, polypropylene oxides, polyesters, and the like.

Preferably, a polyester based upon an azelaic acid and a diol such as propylene glycol, and the like, in the range of 0.3 to 20% by weight is used as the thickener.

Combinations of antioxidants and/or acid acceptors in amounts ranging from about 0.1 to about 5% by weight can also be incorporated into the functional fluid composition, such as, epoxides and/or amines. The combination of 3,4-epoxycyclohexylmethyl 3,4-epoxycyclohexane carboxylate and phenyl-alphanaphthylamine has been found to be very effective.

Corrosion inhibitors such as benzotriazole, quinizarin or the like in an amount ranging between 0.001 and 0.5% by weight can be added to the mixture and thoroughly blended therewith. A dye in a concentration range between 5 and 20 parts per million can be added to the composition and blended therewith in a conventional manner. Effective amounts of a silicone antifoaming agent can also be incorporated into the composition and are usually most effective in an amount ranging between 5 and 50 parts per million.

The functional fluids of this invention can contain up to about 1% by weight of water. It is preferred, however, to maintain water levels below 0.6 weight percent, and most preferably below about 0.3 weight percent.

The invention can be illustrated by the following non-limiting examples.

In the examples and throughout the specification, all parts and percentages are by weight, unless otherwise noted.

EXAMPLE 1

A base stock consisting of 78.98 weight percent of tributyl phosphate and 9.70 weight percent of mixed cresyl and xylenyl phosphates with a viscosity of approximately 220 Saybolt Universal Seconds at 100° F. is combined with 9.00 weight percent of a polyester thickener, Plastolein® 9789 sold by Emergy Industries. Thereafter, 1.0 weight percent of 3,4-epoxycyclohexylmethyl 3,4-epoxycyclohexane carboxylate and 1.0 weight percent of phenyl alpha-naphthylamine are blended into this mixture. Then 0.02 weight percent of benzotriazole is thoroughly blended therewith along with conventional dye and antifoam agent in the amount of 20 parts per million, and 15 parts per million, respectively. Thereafter, dodecyl trimethyl ammonium diphenyl phosphate is blended into the mixture at various addition levels including 0.1% and 0.3% by weight.

The composition prepared as above was tested in an apparatus consisting of a Boeing 737 trailing edge flap valve pressurized by a Vickers axial piston pump together with related equipment required to assure that the apparatus will operate according to the requirements of Section 10.2 of SAE specification AS 1241 pertaining to the erosion resistance of fire resistant aircraft hydraulic fluids. Fluids are evaluated on the basis of leakage rate increase for the valve when it is in the closed or null position. The results of the dodecyl trimethyl ammonium diphenyl phosphate addition into the phosphate ester fluid are as follows:

| % BY WEIGHT OF DODECYL TRIMETHYL AMMONIUM DIPHENYL PHOSPHATE | LEAKAGE RATE INCREASE (cc/min/hr.) | CONDUCTIVITY (micromhos/cm) |
|---|---|---|
| None | 7.0 | 0.021 |
| 0.1 | 2.0 | 0.10 |
| 0.3 | 0.0 | 0.29 |

The test results show that the addition of an effective amount of dodecyl trimethyl ammonium diphenyl phosphate to a phosphate ester hydraulic fluid inhibits damage to hydraulic systems.

EXAMPLE 2

A similar erosion test was performed on the phosphate ester fluid described in Example 1 with 0.3% by weight of dodecyl trimethyl ammonium diphenyl phosphate. In this test the concentration of chlorinated solvents was gradually increased up to a final level of 2000 parts per million (PPM) of chlorine.

| Total Chlorine (PPM) | Total Test Time (Hrs.) | Leakage Rate Increase(cc/min/hr) |
|---|---|---|
| 40 (base level) | 440 | 0 |
| 275 (as $CH_3CCl_3$) | 625 | 0 |
| 444 (as $CH_3CCl_3$) | 730 | 0 |
| 938 (as $CH_3CCl_3$) | 830 | 0 |
| 2000 (as $CH_3CCl_3$ and $CF_2ClCCl_2F$) | 910 | 0 |

This data has been plotted in the FIGURE and illustrates the utility of dodecyl trimethyl ammonium diphenyl phosphate for preventing damage caused to hydraulic systems by chlorine contaminated phosphate ester hydraulic fluids.

EXAMPLE 3

An erosion test was performed on a Boeing Material Spec. 311C (BMS 311-C) qualified phosphate ester aircraft hydraulic fluid contaminated with 1000 PPM of chlorine as 1,1,1-trichloroethane. After the erosion rate was established, the phosphate ester fluid described in Example 1 with 0.3% by weight of dodecyl trimethyl ammonium diphenyl phosphate was added in increments to the contaminated fluid. The following data was obtained in this test:

| QUALIFIED BMS 311-C PHOSPHATE ESTER HYDRAULIC FLUID + 1000 PPM CHLORINE AS $CH_3CCl_3$ | |
|---|---|
| Total Wt. % of Phosphate Ester Fluid Containing 0.3% by Wt. of Dodecyl Trimethyl Ammonium Diphenyl Phosphate | Leakage Rate Increase (cc/min/hr) |
| None | 6.0 |
| 20 | 6.0 |
| 35 | 0.8 |
| 50 | 0 |

The above results illustrate the utility of a formulation containing dodecyl trimethyl ammonium diphenyl phosphate for arresting the damage caused to hydraulic systems by chlorine contaminated phosphate ester hydraulic fluids.

EXAMPLE 4

A blend similar to that described in Example 1 was prepared. Two formulations were prepared with this blend. The first contained 0.2 weight percent of dodecyl trimethyl ammonium diphenyl phosphate and the second contained 0.2 weight percent of trioctyl methyl phosphonium dimethyl phosphate. These formulations were subjected to stability tests described in Boeing Material Specification 311-C. The following results were obtained in these tests:

Boeing Thermal Stability Test

Test Conditions: 250° F., 168 hours duration, steel, magnesium, cadmium plated steel, copper, and aluminum present as catalysts.

| Fluid | Viscosity Change (cs) 100° F. | Viscosity Change (cs) 210° F. | Acid No. Increase (mgKOH/g) |
|---|---|---|---|
| Base Blend + 0.2 Weight Percent Dodecyl Trimethyl Ammonium Diphenyl Phosphate | +0.10 | +0.03 | 0 |
| Base Blend + 0.2 Weight Percent Trioctyl Methyl Phosphonium Dimethyl Phosphate | −1.11 | −0.42 | 1.2 |
| BMS 311-C Specification Limits | ∓1.0 | ±0.3 | +0.5 |

These tests demonstrate that formulations prepared with dodecyl trimethyl ammonium diphenyl phosphate as an additive exhibit greater thermal and oxidative stability than formulations prepared with trioctyl methyl phosphonium dimethylphosphate.

EXAMPLE 5

The following compositions were tested in an apparatus consisting of a Boeing 737 trailing edge flap valve pressurized by a Vickers' axial piston pump, together with related equipment required to assure that the apparatus will operate according to the requirements of Section 10.2 of SAE Specification AS 1241 pertaining to the erosion resistance of fire resistant aircraft hydraulic fluids. Fluids were evaluated on the basis of leakage rate increase for the valve when it was in the null or closed position. The base fluid utilized for this test was Stauffer's Aerosafe TM 2300W, comprising a mixture of triaryl and trialkyl phosphates. The results of these tests are tabulated below:

| Additive | Percent By Weight | Leakage Rate Increase (cc/min./hr.) |
|---|---|---|
| None | None | +22 |
| Dodecyl trimethyl ammonium methyl methyl phosphonate | 0.3 | +1.2 |
| Hexadecyl ethyl dimethyl ammonium diethyl phosphate | 0.5 | −0.8 |
| Benzyl trimethyl ammonium diphenyl phosphate | 0.3 | +0.3 |
| Benzyl trimethyl ammonium bis-nonylphenyl phosphate | 0.3 | +0.3 |
| Benzyl phenylethyl dimethyl ammonium bis-phenylethyl phosphate | 0.3 | −0.8 |
| 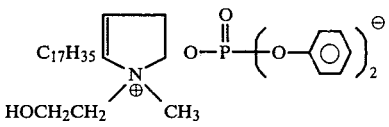 | 0.3 | −0.8 |
| 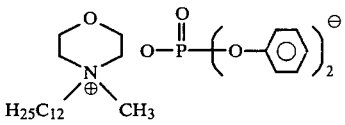 | 0.3 | +1.6 |

EXAMPLE 6

Illustrative Embodiment

In an erosion test conducted in a manner similar to that described in Example 1, a fluid comprised of approximately 50% mixed alkyl substituted phosphate ester, 40% aromatic mineral oil, such as NUSO ® 95, sold by Sun Oil Co., 10% pentaerythritol tetraheptanoate, and 0.2% nonyl trimethyl ammonium dioctyl phosphate will exhibit less metal damage than the same fluid without the ammonium phosphate.

What is claimed is:

1. A functional fluid which comprises:

(a) major amount of a base stock material selected from the group consisting of esters of an acid of phosphorus, amides of an acid of phosphorus, mixtures of esters and amides of an acid of phosphorus, and blends of the aforesaid with one or more materials selected from the group consisting of mineral oils, synthetic hydrocarbon oils, orthosilicates, alkoxypolysiloxanes, silicones, polyphenyl ethers, polyphenyl thioethers, chlorinated biphenyls, esters of dicarboxylic acids and monohydric alcohols, esters of monocarboxylic acids and monohydric alcohols, esters of monocarboxylic acids and polyhydric alcohols, polyalkylene ether alcohols and esters thereof, and blends thereof; said esters and amides of an acid of phosphorus having the formula:

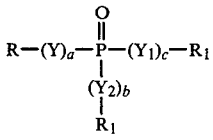

wherein Y is selected from the group consisting of oxygen, sulfur, and $$-\overset{R_3}{\overset{|}{N}}-$$

$Y_1$ is selected from the group consisting of oxygen, sulfur, and $$-\overset{R_4}{\overset{|}{N}}-$$

$Y_2$ is selected from the group consisting of oxygen, sulfur, and $$-\overset{R_5}{\overset{|}{N}}-$$

R, $R_1$, $R_2$, $R_3$, $R_4$, and $R_5$ are each selected from the group consisting of alkyl, alkoxy, aryl, substituted aryl and substituted alkyl; and a, b, and c are whole numbers having a value of 0 to 1 such that the sum a+b+c has a value from 1 to 3; and (b) an effective erosion inhibiting amount of N-methyl, N-butyl piperidinium dibutyl phosphate.

2. A functional fluid which comprises: (a) a major amount of base stock material selected from the group consisting of esters of an acid of phosphorus, amides of an acid of phosphorus, mixtures of esters and amides of an acid of phosphorus, and blends of the aforesaid with one or more materials selected from the group consisting of mineral oils, synthetic hydrocarbon oils, orthosilicates, alkoxypolysiloxanes, silicones, polyphenyl ethers, polyphenyl thioethers, chlorinated biphenyls, esters of dicarboxylic acids and monohydric alcohols, esters of monocarboxylic acids and monohydric alcohols, esters of monocarboxylic acids and polyhydric alcohols, polyalkylene ether alcohols and esters thereof, and blends thereof, wherein said esters and amides of an acid of phosphorus have the formula:

$$R-(Y)_a-\overset{\overset{O}{\|}}{\underset{\underset{R_1}{|}}{\underset{(Y_2)_b}{\underset{|}{P}}}}-(Y_1)_c-R_1$$

wherein Y is selected from the group consisting of oxygen, sulfur and $$-\overset{R_3}{\overset{|}{N}}-$$

$Y_1$ is selected from the group consisting of oxygen, sulfur and $$-\overset{R_4}{\overset{|}{N}}-$$

$Y_2$ is selected from the group consisting of oxygen, sulfur and $$-\overset{R_5}{\overset{|}{N}}-$$

R, $R_1$, $R_2$, $R_3$, $R_4$ and $R_5$ are selected from the group consisting of alkyl, alkoxy, aryl, substituted aryl and substituted alkyl; and a, b and c are whole numbers having a value of 0 to 1 such that the sum a+b+c has a value from 1 to 3; and (b) an effective erosion inhibiting amount of 1,3,5-trimethyl pyridinium diphenyl phosphate.

3. In a method for inhibiting damage in an hydraulic environment containing a major amount of a base stock material selected from the group consisting of esters of an acid of phosphorus, amides of an acid of phosphorus, mixtures of esters and amides of an acid of phosphorus, and blends of the aforesaid with one or more materials selected from the group consisting of mineral oils, synthetic hydrocarbon oils, orthosilicates, alkoxypolysiloxanes, silicones, polyphenyl ethers, polyphenyl thioethers, chlorinated biphenyls, esters of dicarboxylic acids and monohydric alcohols, esters of monocarboxylic acids and polyhydric alcohols, polyalkylene ether alcohols and esters thereof, and blends thereof; the improvement which comprises deploying an effective erosion inhibiting amount of N-methyl, N-butyl piperidinium dibutyl phosphate.

4. In a method for inhibiting damage in a hydraulic environment containing a major amount of a base stock material selected from the group consisting of esters of an acid of phosphorus, amides of an acid of phosphorus, mixtures of esters and amides of an acid of phosphorus, and blends of the aforesaid with one or more materials selected from the group consisting of mineral oils, synthetic hydrocarbon oils, orthosilicates, alkoxypolysiloxanes, silicones, polyphenyl ethers, polyphenyl thioethers, chlorinated biphenyls, esters of dicarboxylic acids and monohydric alcohols, esters of monocarboxylic acids and monohydric alcohols, esters of monocarboxylic acids and polyhydric alcohols, polyalkylene ether alcohols and esters thereof, and blends thereof; the improvement which comprises deploying an effection erosion inhibiting amount of 1,3,5-trimethyl pyridinium diphenyl phosphate.

5. A method of operating an hydraulic pressure device wherein a displacing force is transmitted to a displaceable member by means of a hydraulic fluid comprising a major amount of base stock material selected from the group consisting of esters of an acid of phosphorus, amides of an acid of phosphorus, mixtures of esters and amides of an acid of phosphorus, mixtures of esters and amides of an acid of phosphorus and blends of the aforesaid with one or more materials selected from the group consisting of mineral oils, synthetic hydrocarbon oils, orthosilicates, alkoxypolysiloxanes, silicones, polyphenyl ethers, polyphenyl thioethers, chlorinated biphenyls, esters of dicarboxylic acids and monohydric alcohols, esters of monocarboxylic acids and monohydric alcohols, esters of monocarboxylic acids and polyhydric alcohols, polyalkylene ether alcohols and esters thereof, and blends thereof; and (b) an effective erosion inhibiting amount of an ammonium salt of a phosphorus acid consisting of 1,3,5-trimethyl pyridinium diphenyl phosphate.

6. The methodd of claim 5 wherein the salt of a phosphorus acid in part (b) is N-methyl, N-butyl piperidinium dibutyl phosphate.

* * * * *

UNITED STATES PATENT AND TRADEMARK OFFICE

CERTIFICATE OF CORRECTION

PATENT NO. : 4,252,662

DATED : February 24, 1981

INVENTOR(S) : Theodore A. Marolewski et al.

It is certified that error appears in the above—identified patent and that said Letters Patent is hereby corrected as shown below:

Column 6, line 60, " $R_4N^{\oplus}\ OP(O)\ (OR)_2$ +NaCl" should read -- $R_4N^{\oplus}\ OP(O)\ (OR)_2^{\ominus}$ + NaCl --.

Column 20, line 65, "METHODD" should read -- METHOD --.

Column 18, line 43, "(a) MAJOR AMOUNT" should read -- (a) A MAJOR AMOUNT --

Column 20, line 42, "EFFECTION" should read -- EFFECTIVE --.

Signed and Sealed this

*Fifth* Day of *October 1982*

[SEAL]

*Attest:*

GERALD J. MOSSINGHOFF

*Attesting Officer*

*Commissioner of Patents and Trademarks*